US009897357B2

(12) United States Patent
Hancock

(10) Patent No.: US 9,897,357 B2
(45) Date of Patent: Feb. 20, 2018

(54) ISENTROPIC EXPANSION DEVICE

(71) Applicant: Trane International Inc., Piscataway, NJ (US)

(72) Inventor: Stephen S. Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 177 days.

(21) Appl. No.: 14/824,861

(22) Filed: Aug. 12, 2015

(65) Prior Publication Data

US 2016/0047582 A1 Feb. 18, 2016

Related U.S. Application Data

(60) Provisional application No. 62/036,800, filed on Aug. 13, 2014.

(51) Int. Cl.

| | |
|---|---|
| ***F25B 41/06*** | (2006.01) |
| ***F25B 13/00*** | (2006.01) |
| ***F25B 49/02*** | (2006.01) |

(52) U.S. Cl.

CPC ..... *F25B 41/062* (2013.01); *F25B 13/00* (2013.01); *F25B 49/02* (2013.01)

(58) Field of Classification Search

CPC ..... F25B 41/062; F25B 13/00; F25B 49/02; F25B 41/06; F25B 471/067; F25B 2341/062; F25B 9/04; F25B 9/08; F25B 2341/0115; F25B 41/067; B60H 1/00478; B60H 1/00285

USPC ..... 62/115

See application file for complete search history.

(56) References Cited

U.S. PATENT DOCUMENTS

| | | | | |
|---|---|---|---|---|
| 4,316,366 | A * | 2/1982 | Manning | F25B 5/00 62/200 |
| 5,740,681 | A * | 4/1998 | Karl | B60H 1/00007 237/2 B |
| 2006/0207285 | A1* | 9/2006 | Oshitani | F25B 5/00 62/500 |
| 2014/0208784 | A1* | 7/2014 | Goenka | F25B 41/062 62/115 |
| 2015/0135749 | A1* | 5/2015 | Ohta | F16K 11/048 62/151 |
| 2016/0116195 | A1* | 4/2016 | Nishijima | F04F 5/16 62/500 |

OTHER PUBLICATIONS

Springer, "Venturi Tube Design Ch. 3", http://link.springer.com/chapter/10.1007%2F978-3-319-16880-7_3, Apr. 30, 2015.*

* cited by examiner

*Primary Examiner* — Cassey D Bauer
(74) *Attorney, Agent, or Firm* — Conley Rose, P.C.; J. Robert Brown, Jr.

(57) ABSTRACT

Systems and methods may include a heating, ventilation, and air conditioning (HVAC) system having a heat exchanger and an expansion device disposed upstream and in fluid communication with the heat exchanger. The expansion device includes a pressure recovery portion. The expansion device may also include an isentropic expansion device and/or a substantially isentropic expansion device.

16 Claims, 4 Drawing Sheets

ISENTROPIC EXPANSION DEVICE

CROSS-REFERENCE TO RELATED APPLICATIONS

The present application claims priority under 35 U.S.C. 119(e) to U.S. Provisional Patent Application No. 62/036,800 filed on Aug. 13, 2014 by Stephen S. Hancock, and entitled "Isentropic Expansion Device," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) generally comprise one or more heat exchangers generally referred to as "condensers" that may be comprise a condenser coil, and may be associated with one or more compressors and a fan assembly. In operation, a compressor may compress refrigerant and discharge superheated refrigerant (i.e., refrigerant at a temperature greater than a saturation temperature of the refrigerant) to the condenser coil. As the refrigerant passes through the condenser coil, a fan assembly may be configured to selectively force air into contact with the condenser coil. In response to the air contacting the condenser coil, heat may be transferred from the refrigerant to the air, thereby desuperheating and condensing the refrigerant and/or otherwise reducing a temperature of the refrigerant.

Refrigerant may generally exit the condenser coil in a liquid phase and/or a gaseous and liquid mixed phase. The refrigerant may thereafter be delivered from the condenser coil to a refrigerant expansion device where the refrigerant pressure is reduced. The resulting pressure drop in the expansion device results in the saturation temperature of the refrigerant dropping. The resulting lower pressure refrigerant can then be selectively discharged into a so-called evaporator coil of the HVAC system that may provide a cooling function.

SUMMARY

In an embodiment, a heating, ventilation, and air conditioning (HVAC) system comprises a heat exchanger, and an expansion device disposed upstream and in fluid communication with the heat exchanger. The expansion device comprises a pressure recovery portion. The expansion device may be configured to receive a liquid refrigerant and isentropically or substantially isentropically expand the refrigerant. The heat exchanger may be configured to absorb heat from an external fluid. The HVAC system may also include a second expansion device in fluid communication with the expansion device. The second expansion device may comprise at least one of: an electronically controlled motor driven electronic expansion valve (EEV), a thermostatic expansion valve, an isenthalpic expansion valve, a capillary tube assembly, or an orifice. The second expansion device may comprise an isentropic or substantially isentropic expansion device. The refrigerant expansion device may comprise a flow section and an expansion section. A diameter of the flow section and a diameter of the expansion section may be equal at an intersection of the flow section and the expansion section.

In an embodiment, a heating, ventilation, and air conditioning (HVAC) system comprises a refrigerant expansion device that comprises a pressure recovery portion. The refrigerant expansion device may comprise an isentropic expansion device or a substantially isentropic expansion device. The refrigerant expansion device may comprise an inlet section, a flow section, and an expansion section. A diameter of the flow section and a diameter of the expansion section may be equal at an intersection of the flow section and the expansion section. The diameter of the expansion section may increase over its length in a direction of flow. A length of the expansion section may be between about 3 and about 15 times a final diameter of the expansion section. A shoulder may not be present between the flow section and the expansion section.

In an embodiment, a method of operating a heating, ventilation, and air conditioning (HVAC) system, the method comprises receiving a refrigerant at a first pressure at an expansion device, passing the refrigerant through the expansion device in an isentropic or substantially isentropic expansion, and passing the refrigerant to a downstream heat exchanger at a second pressure. The second pressure is less than the first pressure. The refrigerant may be received at the expansion device as a liquid. Passing the refrigerant through the expansion device may comprise passing the refrigerant through a flow section, and passing the refrigerant through an expansion section. The expansion section may be located downstream from the flow section. Passing the refrigerant through the flow section may comprise passing the refrigerant through the flow section in a choked flow condition. Passing the refrigerant through the expansion device may also include flashing a portion of the refrigerant from a liquid state to a vapor state within the flow section. The method may also include absorbing heat in the downstream heat exchanger, and evaporating at least a portion of the refrigerant in the downstream heat exchanger in response to absorbing the heat. A thermodynamic quality of the refrigerant passing to the downstream heat exchanger may be between about 0.01 and about 0.25.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
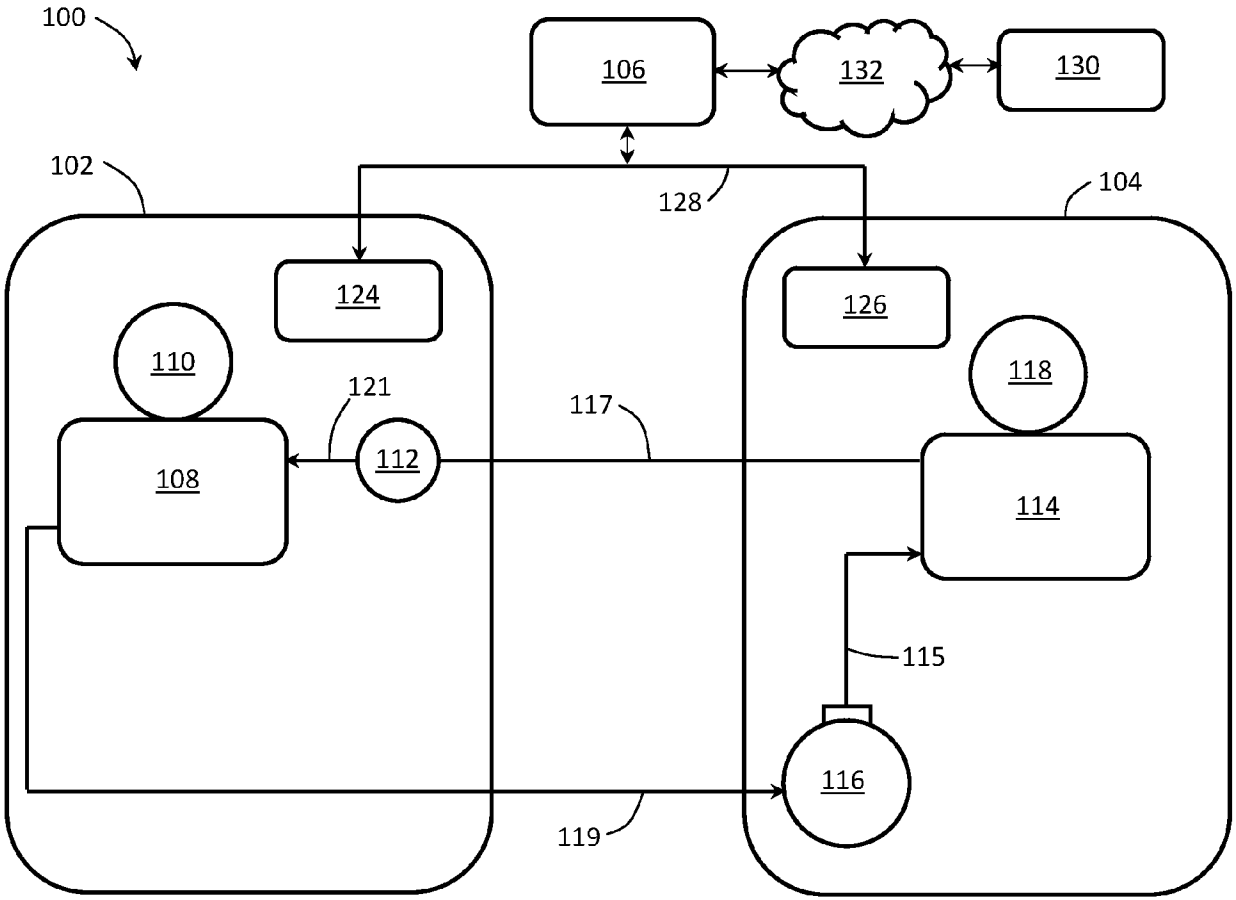
FIG. 1 is simplified schematic diagram of an HVAC system according to an embodiment of the disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

HVAC systems are being improved in order to provide increased efficiency and cooling capacity. Disclosed herein is an HVAC system that utilizes an expansion device having a pressure recovery portion, which reduces losses in the expansion of the two phase refrigerant stream to improve system efficiency. In some embodiments, an orifice type expansion device can be used. As the refrigerant flows through the orifice, the pressure drops and a portion of the refrigerant may flash from a liquid to a vapor. The use of an orifice may result in a turbulent flow within and downstream of the expansion device. The resulting energy loss may result in a refrigerant having a reduced ability to absorb heat within a downstream heat exchanger.

In contrast to an isenthalpic expansion device described above, the expansion device disclosed herein may reduce the expansion losses associated with the refrigerant passing through the expansion device. For example, the expansion device may comprise a pressure recovery portion that may allow the refrigerant to expand in a controlled manner and reduce the amount of turbulence present. The controlled expansion may result in a lower vapor content of the refrigerant leaving the expansion device and a corresponding improvement in energy and process efficiency. The expansion device can be used in conjunction with other expansion devices and/or used in series to provide for a more controlled pressure drop while reducing the overall energy losses associated with an orifice type expansion device.

Referring now to FIG. 1, a simplified schematic diagram of an HVAC system 100 is shown according to an embodiment of the disclosure. HVAC system 100 generally comprises an indoor unit 102, an outdoor unit 104, and a system controller 106. The system controller 106 may generally control operation of the indoor unit 102 and/or the outdoor unit 104.

The HVAC system 100 illustrated in FIG. 1 may be referred to as a split system in some contexts, where the split system 100 comprises an indoor unit 102 located separately from the outdoor unit 104. While a split system is described herein, the systems and methods described herein may be equally applicable to other HVAC systems as well. In some embodiments of an HVAC system 100, the system 100 may comprise a package system in which one or more of the components of the indoor unit 102 and one or more of the components of the outdoor unit 104 are carried together in a common housing or package. In still other embodiments, the HVAC system 100 may comprise a ducted system where the indoor unit 102 is remotely located from the conditioned zones, thereby requiring air ducts to route the circulating air.

Indoor unit 102 generally comprises an indoor heat exchanger 108, an indoor fan 110, and an expansion device 112. The indoor heat exchanger 108 is configured to allow heat exchange between a refrigerant carried within internal tubing of the indoor heat exchanger 108 and fluids that contact the indoor heat exchanger 108 but that are kept segregated from the refrigerant. In a cooling mode, the refrigerant received within the indoor heat exchanger 108 can be cooler than the fluid passing over the exterior of the indoor heat exchanger 108. The resulting heat absorption by the refrigerant within the indoor heat exchanger may result in the vaporization of the refrigerant within the indoor heat exchanger 108. For this reason, the indoor heat exchanger may be referred to as an evaporator or evaporator exchanger in some contexts. Various types of exchangers can be used as the indoor heat exchanger 108 including, but not limited to, a plate fin heat exchanger, a spine fin heat exchanger, a microchannel heat exchanger, or any other suitable type of heat exchanger.

The indoor fan 110 serves to create the flow of the fluid that contacts the indoor heat exchanger 108. In general, the indoor fan 110 drives an air flow over the exterior of the indoor heat exchanger 108 tubes as well as driving the ventilation system to circulate the air within the indoor environment. While described as a fan, various types of fans and blowers can be used as the indoor fan 110. In an embodiment, the indoor fan 110 may be a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 may be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The expansion device 112 is configured to receive a relatively high-pressure refrigerant from the outdoor heat exchanger 114 and reduce the pressure of the refrigerant (e.g., expanding the refrigerant) as measured across the expansion device 112 prior to the refrigerant entering the indoor heat exchanger 108. In this embodiment, the expansion device 112 is disposed between and is in fluid communication with the outlet of the outdoor heat exchanger 114 and the inlet of the indoor heat exchanger 108. In some embodiments, the expansion device 112 may also control an amount of refrigerant passing through the expansion device 112. The pressure reduction results in a cooling of the refrigerant, which is then used to absorb heat into the refrigerant in the indoor heat exchanger 108 while correspondingly cooling the fluid (e.g., the indoor air) passing over the indoor heat exchanger 108.

Figure 2:
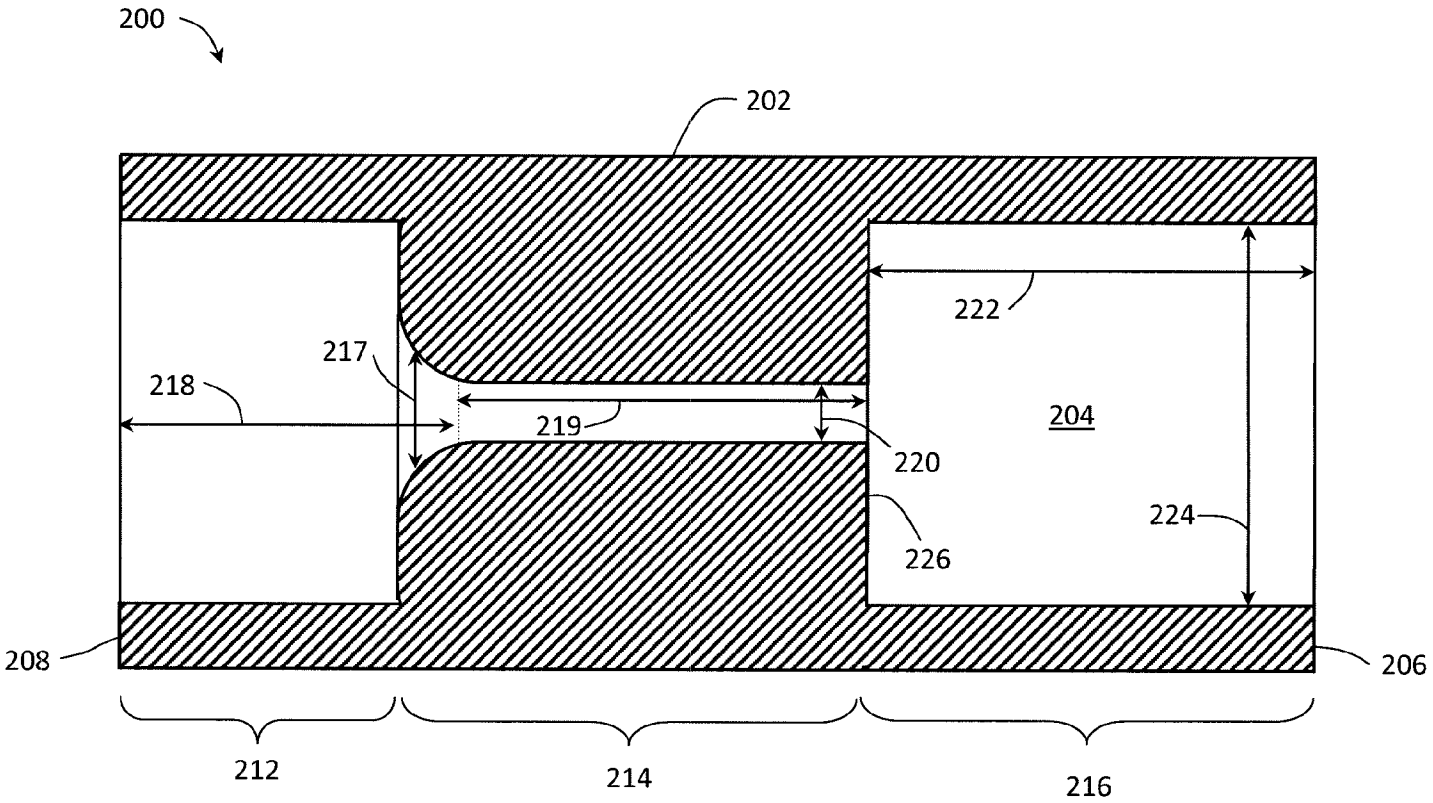
FIG. 2 is a simplified cross-sectional view of an expansion device according to an embodiment of the disclosure.

Referring to the cross-sectional view illustrated in FIG. 2, an embodiment of an expansion device 200 is shown in greater detail. The expansion device 200 comprises a generally cylindrical body 202 defining an interior flowpath 204. The expansion device 200 may comprise an upstream end 208 that receives refrigerant from the outdoor heat exchanger 114 and a downstream end 206 that provides fluid communication with the interior heat exchanger 108. Each end 206, 208 may be coupled to a refrigerant line and may or may not be in fluid communication with an additional expansion or control device. The body 202 may be constructed of any suitable materials. The expansion device 200 may be integrally formed from a single body 202 portion, although it will be appreciated by one of ordinary skill in the art that the various sections of the expansion device 200 may be contained in separate components that are coupled together.

The interior flowpath 204 is positioned within the body 202 to provide fluid communication through the expansion device 200. The interior flowpath 204 may be positioned concentrically within the body 202 and may be cylindrical in shape, however, in some embodiments, the shape of the interior flowpath may vary to some degree. The diameter of the interior flowpath 204 may be chosen to provide the desired fluid flow rate and fluid velocity at the appropriate operating conditions (e.g., pressure, temperature, etc.) and refrigerant type.

As shown in FIG. 2, the body 202 may be configured to provide several flow sections of the interior flowpath 204. For example, the interior flowpath 204 may comprise an inlet section 212, a flow section 214, and an expansion section 216. Refrigerant flowing into the expansion device 200 may first flow through the inlet section 212. The inlet section 212 may have a decreasing diameter 217 along its length 218 between the upstream end 208 of the body 202 and the interface with the flow section 214. The diameter 217 may decrease gradually (e.g., over a curved surface) or may decrease in one or more steps, which may correspond to one or more sharp edges. In an embodiment, the diameter 220 of the flow section 214 may extend to the upstream end 208 of the expansion device 200, in which case the inlet section 212 may not be considered to be present. The flow section 214 may have a relatively uniform diameter 220 along its length 219. The expansion section 216 may extend from the flow section to the downstream end 206 of the body. The diameter of the expansion section 216 may be greater than the diameter 220 of the flow section 214 and may be relatively uniform along its length 222.

In the embodiment illustrated in FIG. 2, the diameter 220 of the flow section 214 is less than the diameter 224 of the expansion section 216, thereby creating a shoulder 226 at the intersection of the flow section 214 and the expansion section 216. The shoulder 226 may be formed as an edge disposed perpendicular to the central longitudinal axis of the interior flowpath 204. In an embodiment, the shoulder may be formed of a generally flat edge that may be tilted up to about 30 degrees from a plane perpendicular to the longitudinal axis of the interior flowpath 204. The relatively sharp transition between the flow section 214 and the expansion section may result in a relatively uncontrolled expansion of the refrigerant.

The expansion device 200 may result in an isenthalpic or substantially isenthalpic expansion. In this embodiment, the refrigerant may enter the expansion device 200 through the upstream end 208. The refrigerant may be in the liquid phase, though a minor portion of the refrigerant may be in a vapor phase if the outdoor heat exchanger 114 does not entirely condense the refrigerant. As the refrigerant enters the inlet section 212, the refrigerant may flow into the flow section 214. The flow section 214 may be sized to result in a desired pressure drop. The pressure within the refrigerant may drop within the flow section 214, and a portion of the refrigerant may flash from a liquid state to a vapor state. The properties of the flow section 214 and/or the resulting flashing of the refrigerant may result in a choked flow condition of the refrigerant within the flow section 214. In this condition, the flow rate of the refrigerant through the flow section 214 is substantially independent of the downstream pressure. As the refrigerant passes out of the flow section, the refrigerant may rapidly expand into the expansion section 216 due to the presence of the shoulder 226. The resulting turbulence may result in a conversion of the energy in the refrigerant stream into heat, which results in the refrigerant stream leaving the expansion device 200 having an increased thermodynamic quality and a decreased ability to absorb heat in the indoor heat exchanger. As used herein, the thermodynamic quality refers to the mass fraction in a saturated mixture that is vapor. For example, the refrigerant leaving the expansion device 200 may comprise a thermodynamic quality between about 0.15 and 0.3. Further, the resulting expansion of the refrigerant through the expansion device 200 may reduce the overall efficiency of the system 100 due to the uncontrolled nature of the expansion as it passes from the flow section 214 to the expansion 216 of between about 0.5% and about 5%. The resulting efficiency loss or reduction may hold true for other isenthalpic expansion devices as well.

In some embodiments, the expansion device may comprise a pressure recovery portion that may reduce the efficiency loss associated with an isenthalpic or isenthalpic type expansion device. In an embodiment, the expansion device may comprise a flow section coupled to an expansion section having a smooth transition between the two sections that does not result in a shoulder. Further, the expansion section may have a continuous expansion along its length to provide for a controlled expansion of the refrigerant passing therethrough. The smooth transition and/or the continuous expansion may be referred to as a pressure recovery portion or section.

Figure 3:
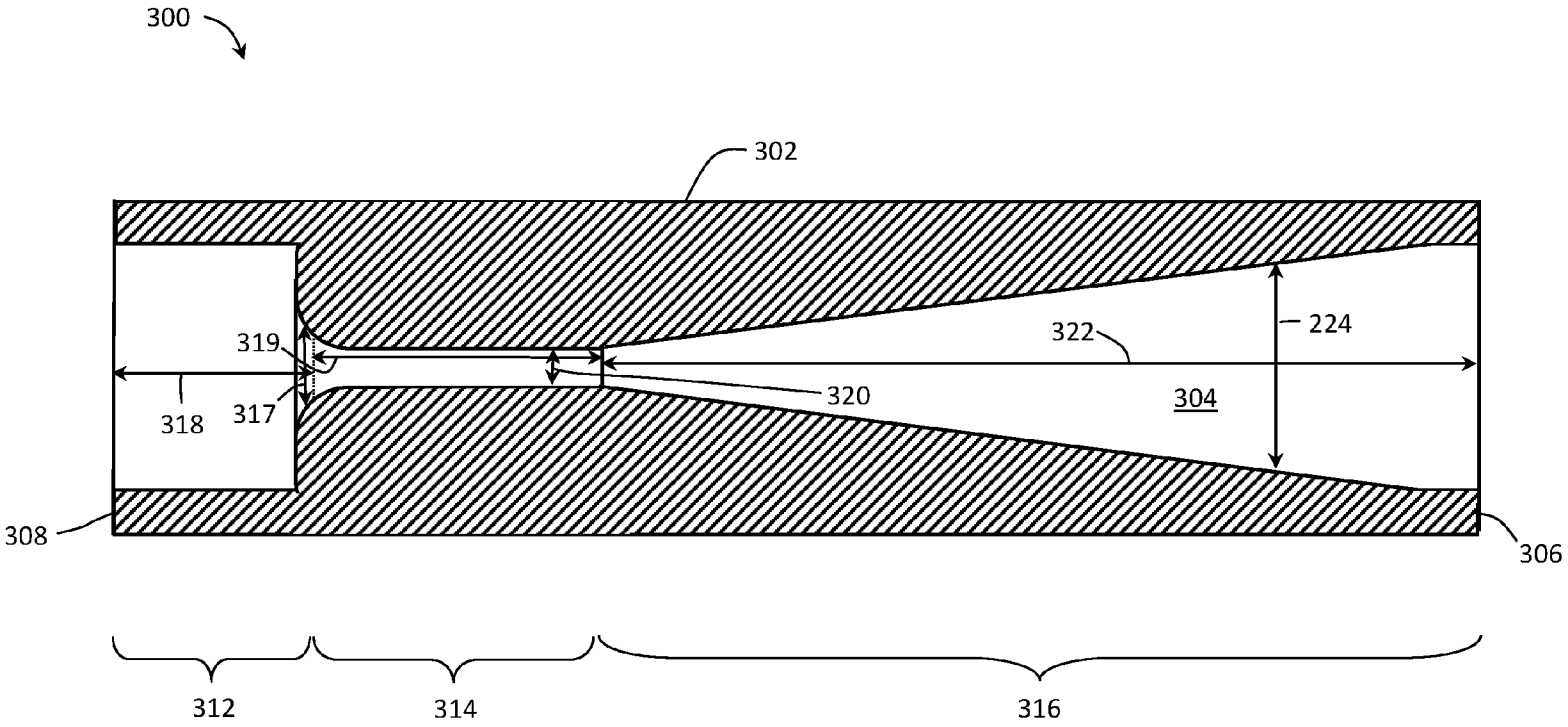
FIG. 3 is a simplified cross-sectional view of another expansion device according to an embodiment of the disclosure.

As shown in the cross-sectional view of FIG. 3, another embodiment of an expansion device 300 is shown in greater detail. The expansion device 300 illustrated in FIG. 3 is similar to the expansion device 200 illustrated in FIG. 2, and similar components will not be described in detail in the interest of clarity and brevity. The expansion device 300 comprises a generally cylindrical body 302 defining an interior flowpath 304. The expansion device 300 may comprise an upstream end 308 that receives refrigerant from the outdoor heat exchanger 114 and a downstream end 306 that provides fluid communication with the interior heat exchanger 108. Each end 306, 308 may be coupled to a refrigerant line and may or may not be in fluid communication with an additional expansion or control device. The body 302 may be constructed of any suitable materials. The expansion device 300 may be integrally formed from a single body 302 portion, although it will be appreciated by one of ordinary skill in the art that the various sections of the expansion device 300 may be contained in separate components that are coupled together.

The interior flowpath 304 is positioned within the body 302 to provide fluid communication through the expansion device 300. The interior flowpath 304 may be positioned concentrically within the body 302 and may generally be cylindrical in shape, however, in some embodiments, the shape of the interior flowpath may vary to some degree. The diameter of the interior flowpath 304 may vary along the length of the expansion device 300 and may be chosen to provide the desired fluid flow rate and fluid velocity at the appropriate operating conditions (e.g., pressure, temperature, etc.) and refrigerant type.

As shown in FIG. 3, the body 302 may be configured to provide several flow sections of the interior flowpath 304. For example, the interior flowpath 304 may comprise an inlet section 312, a flow section 314, and an expansion section 316. The inlet section 312 and the flow section 314 may be the same or similar to the inlet and flow sections described with respect to FIG. 2 (e.g., the inlet section 212, and the flow section 214). Refrigerant flowing into the expansion device 300 may first flow through the inlet section 312. The inlet section 312 may have a decreasing diameter 317 along its length 318 between the upstream end 308 of the body 302 and the interface with the flow section 314. The diameter 317 may decrease gradually (e.g., over a curved surface) or may decrease in one or more steps, which may correspond to one or more sharp edges. In an embodiment, the diameter 320 of the flow section 314 may extend to the upstream end 308 of the expansion device 300, in which case the inlet section 312 may not be considered to be present. The flow section 314 may have a relatively uniform diameter 320 along its length 319.

The expansion section 316 may extend from the flow section to the downstream end 306 of the body 302. The diameter 324 of the expansion section 316 may be approximately the same as the diameter 320 of the flow section 314 at the upstream end of the expansion section 316. As a result, the transition from the flow section 314 to the expansion section 316 may be relatively uniform or smooth. The diameter 324 of the expansion section 316 may vary over the length 322 of the expansion section 316. As shown in FIG. 3, the diameter 324 may increase linearly from the upstream end of the expansion section 316 to the downstream end 306 of the expansion device 300. In some embodiments, the diameter 324 may expand non-linearly over the length 322 of the expansion section 316. For example, the diameter 324 may expand and present a concave or convex curve as viewed from within the interior flowpath. The diameter 324 may comprise a curved surface having a constant or variable radius of curvature. Further, combinations of these types of shapes may also be possible. For example, the diameter may increase over a curved surface for a portion of the length 322 of the expansion section 316 while increasing linearly over another portion of the length 322 of the expansion section 316.

In an embodiment, the diameters and lengths of the inlet section 312, the flow section 314, and/or the expansion section 316 may vary. In an embodiment, the length 319 and diameter 320 of the flow section 314 may be selected to provide for a desired pressure drop and/or a choked flow condition of the refrigerant within the flow section 314. In general, the length 319 of the flow section 314 may be greater than about three times its diameter 320, alternatively greater than about four times its diameter 320. The diameter 320 of the flow section 314 may be measured as the minimum diameter of the flow section 314 when the diameter 320 varies over the length 319 of the flow section 314. The length 322 of the expansion section 316 may range from about three to about fifteen times the largest diameter 324 of the expansion section 316.

The expansion device 300 may result in an isentropic or substantially isentropic expansion. As used herein, an isentropic expansion is one that occurs at a substantially constant entropy. A substantially isentropic expansion may occur with an entropy change of less than about 90%, alternatively less than about 95%, or alternatively less than about 98%. In this embodiment, the refrigerant may enter the expansion device 300 through the upstream end 308. The refrigerant may be in the liquid phase, though a portion of the refrigerant may be in a vapor phase if the outdoor heat exchanger 114 does not entirely condense the refrigerant. As the refrigerant enters the inlet section 312, the refrigerant may flow into the flow section 314. The flow section 314 may be sized to result in a desired pressure drop. The pressure within the refrigerant may drop within the flow section 314, and a portion of the refrigerant may flash from a liquid state to a vapor state. The properties of the flow section 314 and/or the resulting flashing of the refrigerant may result in a choked flow condition of the refrigerant within the flow section 314. As the refrigerant passes out of the flow section 314, the refrigerant may gradually expand into the expansion section 316 due to the gradually increasing diameter 324 of the expansion section 322 and/or the smooth transition between the flow section 314 and the expansion section 316.

The gradual expansion may reduce or limit the amount of turbulence occurring during the expansion. As a result, the refrigerant stream leaving the expansion device 300 may have a decreased thermodynamic quality, a lower enthalpy, and an increased ability to absorb heat in the indoor heat exchanger. In an embodiment, the refrigerant leaving the expansion device 300 may comprise a thermodynamic quality that is less than about 0.2, or less than about 0.15. While a lower thermodynamic quality is desired, some amount of vapor may still be formed due to the reduction in pressure within the expansion device 300. As a result, the thermodynamic quality may be at least about 0.05 or at least about 0.1. Further, the resulting expansion of the refrigerant through the expansion device 300 may increase the overall efficiency of the system 100 relative to an isenthalpic expansion device between about 0.5% and about 3%.

Returning to FIG. 1, the expansion device 112 may comprise at least one device comprising a pressure recovery portion such as the expansion device 300 described with respect to FIG. 3 above. In some embodiments, an expansion device 112 comprising a pressure recovery portion may be used in parallel or in series with additional expansion devices. One or more of the additional expansion devices may also comprise a pressure recovery portion. For example, expansion devices such as expansion device 300 described with respect to FIG. 3 may be used in series, and each expansion device may reduce the pressure of the refrigerant a desired amount. Staging the pressure reduction may result in an increased efficiency due to the reduced turbulence and/or energy loss in each stage relative to a single expansion process.

In some embodiments, an expansion device 112 comprising a pressure recovery portion may be used in parallel or in series with additional expansion devices that do not comprise a pressure recovery section. Additional expansion devices can include, but are not limited to, an electronically controlled motor driven electronic expansion valve (EEV), a thermostatic expansion valve, an isenthalpic expansion valve, a capillary tube assembly, an orifice and/or any other suitable expansion device or metering device. The use of the expansion device comprising the pressure recovery portion may improve the overall efficiency of the system by providing a portion of the pressure drop in a controlled process. For example, a portion of the pressure drop may occur in an isentropic or substantially isentropic process. In some embodiments, the expansion device 112 may comprise and/or be associated with a refrigerant check valve and/or refrigerant bypass.

The outdoor unit 104 generally comprises an outdoor heat exchanger 114, a compressor 116, and an outdoor fan 118. The outdoor heat exchanger 114 is configured to allow heat exchange between a refrigerant carried within internal tubing of the outdoor heat exchanger 114 and fluids (e.g., outdoor air) that contact the outdoor heat exchanger 114 but that are kept segregated from the refrigerant. In a cooling mode, the refrigerant received within the outdoor heat exchanger 114 through inlet line 115 can be warmer than the fluid passing over the exterior of the outdoor heat exchanger 114. The resulting heat loss by the refrigerant within the outdoor heat exchanger 114 may result in the partial or complete condensation of the refrigerant within the outdoor heat exchanger 114. For this reason, the outdoor heat exchanger 114 may be referred to as a condenser or condenser exchanger in some contexts. Various types of exchangers can be used as the outdoor heat exchanger 114 including, but not limited to, a plate fin heat exchanger, a spine fin heat exchanger, a microchannel heat exchanger, or any other suitable type of heat exchanger.

While the outdoor heat exchanger 114 is described as being outside or outdoors, the outdoor heat exchanger 114 does not have to be installed physically outdoors. For example, the outdoor heat exchanger 114 can be installed within a building while having ducting to contact exterior air with the outdoor heat exchanger 114. In some embodiments, the heat exchange between the outdoor heat exchanger 114 and the exterior or outdoor air can occur directly or indirectly via an intermediate heat transfer fluid.

The compressor 116 can be disposed between and in fluid communication with the outlet of the indoor heat exchanger 108 and the inlet of the outdoor heat exchanger 114. The compressor 116 may be configured to receive the refrigerant from the indoor heat exchanger 108 through line 119, compress the refrigerant, and pass the refrigerant to the outdoor heat exchanger 114 through line 115. As the refrigerant is compressed, the pressure and temperature of the refrigerant may rise, thereby allow the heat to be released from the refrigerant within the outdoor heat exchanger 114. Various types of compressors are known and may be suitable for use with the system 100. In an embodiment, the compressor 116 may comprise a multiple speed scroll type compressor configured to selectively pump refrigerant at a plurality of mass flow rates. In some embodiments, the compressor 116 may comprise a modulating compressor capable of operation over one or more speed ranges, a reciprocating type compressor, a single speed compressor, and/or any other suitable refrigerant compressor and/or refrigerant pump.

In an embodiment, the outdoor heat exchanger 114 may comprise a condensing section and a subcooling section. As used herein, subcooling refers to a reduction in the temperature of the refrigerant below is saturation temperature (e.g., its condensation temperature) at the pressure within the outdoor heat exchanger 114. The condensing section may comprise a main coil, and the subcooling section may comprise a subcooling coil. The terms main coil and subcooling coil can refer to any type of heat exchanger and not meant to describe or be limited to any particular design. In an embodiment, the main coil and the subcooling coil can be two separate heat exchangers, or in some embodiments, they can be combined in various ways, for example by sharing common heat transfer fins. The heat transfer fins may be constructed of metal or any other thermally conductive material to allow for the transfer of heat from the tubes into the heat transfer fins and consequently to the external fluid flowing over the heat transfer fins.

The outdoor fan 118 serves to create the flow of the fluid that contacts the outdoor heat exchanger 114. In general, the outdoor fan 118 drives an air flow over the exterior of the outdoor heat exchanger 118 tubes. While described as a fan, various types of fans and blowers can be used as the indoor fan 110. In an embodiment, the outdoor fan 118 may be an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor fan 118 may be configured to draw air through the outdoor heat exchanger 118 and/or blow air into the outdoor heat exchanger 118. While illustrated as being above the outdoor exchanger 114, the outdoor fan 118 may be disposed below, within, or adjacent the outdoor heat exchanger 114. In some embodiments, the outdoor fan 118 may be configured to create an air flow pattern over the outdoor heat exchanger 114 such that the air passes over the subcooling section prior to passing over the condensing section, thereby creating a counter-current flow pattern within the outdoor heat exchanger 114. In some embodiments, a cross-current flow pattern may be established where the external fluid (e.g., the outdoor air) is drawn across the subcooling section and the condensing section. Any other suitable flow patterns or configurations are also possible.

The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. The system controller 106 may generally comprise a touchscreen interface for displaying information and for receiving user inputs. In some embodiments, the system controller 106 may not comprise a display and may derive all information from inputs from remote sensors and remote configuration tools. In some embodiments, the system controller 106 may comprise and/or be coupled to a temperature sensor and may further be configured to control heating and/or cooling of zones associated with the HVAC system 100. In some embodiments, the system controller 106 may be configured as a thermostat for controlling supply of conditioned air to one or more zones associated with the HVAC system 100.

In some embodiments, the system controller 106 may also selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may be configured to receive information inputs, transmit information outputs, and otherwise communicate with the system controller 106, the outdoor controller 126, and/or any other device 130 via the communication bus 128 and/or any other suitable medium of communication. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner, and communicate with an indoor expansion device controller. In some embodiments, the indoor controller 124 may be configured to communicate with an indoor fan controller and/or otherwise affect control over operation of the indoor fan 110.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller that is configured to electrically power and/or control the compressor 116.

In operation, the HVAC system 100 may be used in a cooling mode in which heat is absorbed by refrigerant at the indoor heat exchanger 108 and heat is rejected from the refrigerant at the outdoor heat exchanger 114. In the cooling mode, a cooled and pressurized refrigerant may be received at the expansion device 112 through line 117. The refrigerant received at the expansion device 112 from the outdoor heat exchanger 114 may comprise a refrigerant that is primarily or completely in the liquid refrigerant. The expansion device 112 may reduce the pressure of the refrigerant as measured from upstream of the expansion device 112 (e.g., in line 117) to downstream of the expansion device 112 (e.g., in line 121). The pressure differential across the expansion device 112 may allow the refrigerant downstream of the expansion device 112 to expand and/or at least partially convert to a two-phase (gas/liquid) mixture.

In an embodiment, the refrigerant received at the expansion device 112 from the outdoor heat exchanger 114 may be expanded in an isentropic process in the expansion device 112. In some embodiments, the expansion device 112 may comprise a pressure recovery section. For example, the expansion device 112 may comprise a flow section upstream of an expansion section. The diameter of the flow section and the expansion section may be substantially the same at the intersection of the two sections, thereby providing a relatively smooth transition without any shoulder between the sections. The expansion section may then expand in diameter from an upstream end to a downstream end. The expansion in the diameter may be relatively smooth so that the refrigerant can expand along the length of the expansion section with a reduced amount of turbulence relative to an expansion device comprising a shoulder or sharp edge.

When the expansion device 112 comprises a pressure recovery section, the refrigerant may enter the expansion device 112 through an upstream end. The refrigerant may be in the liquid phase, though a minor portion of the refrigerant may be in a vapor phase if the outdoor heat exchanger 114 does not entirely condense the refrigerant. The refrigerant may flow through a flow section, which may be sized to result in a desired pressure drop. The pressure within the refrigerant may drop within the flow section, and a portion of the refrigerant may flash from a liquid state to a vapor state. The properties of the flow section and/or the resulting flashing of the refrigerant may result in a choked flow condition of the refrigerant within the flow section. As the refrigerant passes out of the flow section, the refrigerant may gradually expand into the expansion section due to the gradually increasing diameter of the expansion section and/or the smooth transition between the flow section and the expansion section. As a result, the refrigerant stream leaving the expansion device 112 may have an decreased thermodynamic quality, a lower enthalpy, and an increased ability to absorb heat in the indoor heat exchanger relative to a refrigerant passing through an expansion device having a sharp edge such as an isenthalpic expansion device. In an embodiment, the refrigerant leaving the expansion device 112 may comprise a thermodynamic quality that is less than about 0.2, or less than about 0.15, and in some embodiments, the thermodynamic quality may be at least about 0.05 or at least about 0.1. In some embodiments, the refrigerant may pass through one or more additional expansion device or flow metering devices that may comprise a portion of the expansion device 112 and/or are associated with the expansion device 112.

The two phase refrigerant may pass from the expansion device 112 and enter the indoor heat exchanger 108 through line 121. As the refrigerant passes through the indoor heat exchanger 108, the indoor fan 110 may be operated to move air into contact with the indoor heat exchanger 108, thereby transferring heat to the refrigerant from the air surrounding the indoor heat exchanger 108. The liquid portion of the two phase mixture may evaporate and the temperature of the refrigerant may rise in the indoor heat exchanger 108.

The refrigerant may pass out of the indoor heat exchanger 108 through line 119 and enter the compressor 116. The compressor 116 may operate to compress the refrigerant and pump the resulting relatively high temperature and high pressure compressed refrigerant from the compressor 116 to the outdoor heat exchanger 114 through line 115. As the refrigerant is passed through the outdoor heat exchanger 114, the outdoor fan 118 may be operated to move a fluid (e.g., outdoor air) into contact with the outdoor heat exchanger 114, thereby transferring heat from the refrigerant to the air surrounding the outdoor heat exchanger 114. The refrigerant entering the outdoor heat exchanger 114 may primarily comprise a vapor and the refrigerant passing out of the outdoor heat exchanger 114 may primarily comprise liquid phase refrigerant. The refrigerant may flow from the outdoor heat exchanger 114 to the expansion device 112 to repeat the process.

Figure 4:
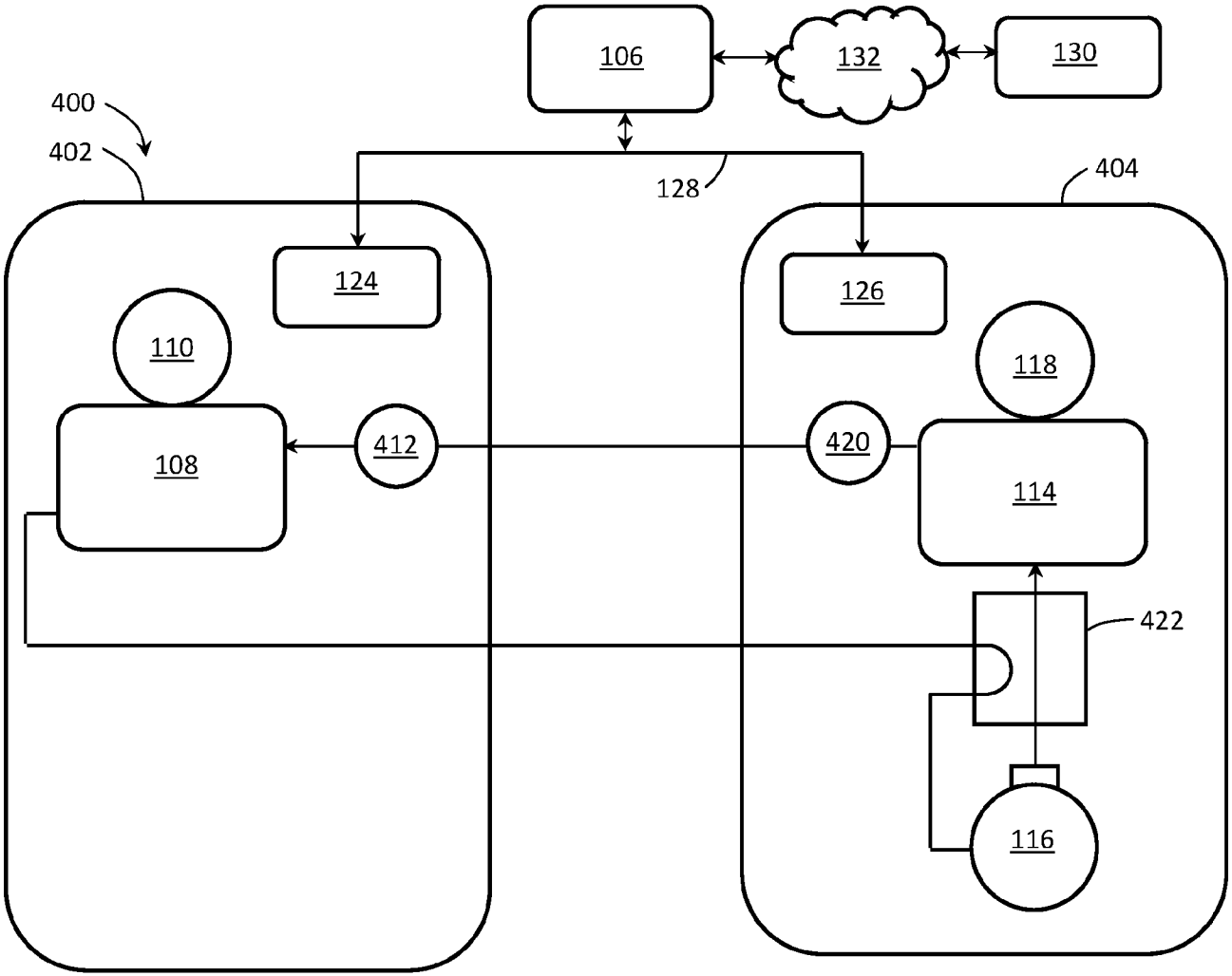
FIG. 4 is a simplified schematic diagram of another HVAC system according to an embodiment of the disclosure.

While the HVAC system described above refers to a system that can generally be used in a cooling mode, the use of the system comprising an expansion valve having a pressure recovery portion (e.g., an isentropic expansion valve) can also be used in a reversible HVAC system 400 as shown in the embodiment depicted in FIG. 4. The simplified diagram of the HVAC system 400 is similar in many respect to the HVAC described with respect to FIG. 1, and accordingly, similar components will not be described for the sake or brevity. In an embodiment, the HVAC system 400 may comprise a so-called heat pump system that may be selectively operated to implement one or more substantially closed thermodynamic refrigeration cycles to provide a cooling functionality and/or a heating functionality. The HVAC system 400 may generally comprise an indoor unit 402, an outdoor unit 404, and a controller 106. The system controller 106 may generally comprise those component described above with respect to the controllers.

The indoor unit 402 generally comprises an indoor heat exchanger 108, an indoor fan 110, and an indoor metering device 412. The indoor heat exchanger 108 and the indoor fan 110 may be the same or similar to the elements described herein. The indoor metering device 412 may be similar to the expansion device 112 described herein. For example, the indoor metering device 412 may comprise an expansion device comprising a pressure recovery section. For example, the indoor metering device 412 may comprise the expansion device 300 as described with respect to FIG. 3. The indoor metering device 412 may also comprise and/or be associated with a refrigerant check valve and/or refrigerant bypass for use when a direction of refrigerant flow through the indoor metering device 412 is such that the indoor metering device 412 is not intended to meter or otherwise substantially restrict flow of the refrigerant through the indoor metering device 412.

The outdoor unit 404 generally comprises an outdoor heat exchanger 114, a compressor 116, an outdoor fan 118, an outdoor metering device 420, and a reversing valve 422. The outdoor heat exchanger 114, the compressor 116, and the outdoor fan 118 may be the same as or similar to any of the corresponding components described herein. The outdoor metering device 420 may be similar to the expansion device 112 described with respect to FIGS. 1 and 3. For example, the outdoor metering device 420 may comprise an expansion device comprising a pressure recovery section. For example, the outdoor metering device 420 may comprise the expansion device 300 as described with respect to FIG. 3. The outdoor metering device 420 may also comprise and/or be associated with a refrigerant check valve and/or refrigerant bypass for use when a direction of refrigerant flow through the outdoor metering device 420 is such that the outdoor metering device 420 is not intended to meter or otherwise substantially restrict flow of the refrigerant through the outdoor metering device 420.

The reversing valve 422 may be configured to selectively control or alter a flow path of refrigerant in the HVAC system 400 as described in greater detail below. In an embodiment, the reversing valve 422 may comprise so-called four-way reversing valve. The reversing valve 422 may comprise an electrical solenoid or other device configured to selectively move a component of the reversing valve 422 between operational positions.

As schematically illustrated in FIG. 4, the HVAC system 400 is shown configured for operating in a so-called cooling mode in which heat is absorbed by refrigerant at the indoor heat exchanger 108 and heat is rejected from the refrigerant at the outdoor heat exchanger 114. In some embodiments, the compressor 116 may be operated to compress refrigerant and pump the relatively high temperature and high pressure compressed refrigerant from the compressor 116 to the outdoor heat exchanger 114 through the reversing valve 422 and to the outdoor heat exchanger 114. As the refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. The refrigerant leaving the outdoor heat exchanger 114 may primarily comprise liquid phase refrigerant. The refrigerant may flow from the outdoor heat exchanger 114 to the indoor metering device 412 through and/or around the outdoor metering device 420 which does not substantially impede flow of the refrigerant in the cooling mode. The indoor metering device 412 may meter passage of the refrigerant through the indoor metering device 412 so that the refrigerant downstream of the indoor metering device 412 is at a lower pressure than the refrigerant upstream of the indoor metering device 412. In an embodiment, the indoor metering device 412 comprises an expansion device having a pressure recovery section. For example, the indoor metering device 412 may comprise a isentropic expansion device. The pressure differential across the indoor metering device 412 may allow the refrigerant downstream of the indoor metering device 412 to expand and/or at least partially convert to a two-phase (vapor and gas) mixture.

The two phase refrigerant may enter the indoor heat exchanger 108. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108, and causing evaporation of the liquid portion of the two phase mixture. The refrigerant leaving the indoor heat exchanger 108 may thereafter re-enter the compressor 116 after passing through the reversing valve 422.

The HVAC system 400 may also be operated in the so-called heating mode. In this configuration, the reversing valve 422 may be controlled to alter the flow path of the refrigerant, the indoor metering device 412 may be disabled and/or bypassed, and the outdoor metering device 420 may be enabled. In the heating mode, refrigerant may flow from the compressor 116 to the indoor heat exchanger 108 through the reversing valve 422, the refrigerant may be substantially unaffected by the indoor metering device 412, the refrigerant may experience a pressure differential across the outdoor metering device 420. In an embodiment, the outdoor metering device 420 comprises an expansion device having a pressure recovery section. For example, the outdoor metering device 420 may comprise a isentropic expansion device. After passing through the outdoor metering device 420 and having the pressure of the refrigerant reduced, the refrigerant may pass through the outdoor heat exchanger 114, and the refrigerant may reenter the compressor 116 after passing through the reversing valve 422. Most generally, operation of the HVAC system 400 in the heating mode reverses the roles of the indoor heat exchanger 108 and the outdoor heat exchanger 114 as compared to their operation in the cooling mode. In the heating mode, heat may be released from the refrigerant in the indoor heat exchanger 108 and absorbed by the outdoor heat exchanger 114.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and air conditioning (HVAC) system comprising:

a heat exchanger; and an expansion device disposed upstream and in fluid communication with the heat exchanger, wherein the expansion device comprises an inlet section, a flow section, and an expansion section comprising a gradually increasing diameter between the flow section and a most downstream end of the expansion device, wherein the flow section comprises a diameter equal to a diameter of a most upstream diameter of the expansion section, and wherein a length of the expansion section is at least 3 times the diameter of the flow section.

2. The HVAC system of claim 1, wherein the expansion device is configured to receive a liquid refrigerant and substantially isentropically expand the refrigerant.

3. The HVAC system of claim 1, wherein the heat exchanger is configured to absorb heat from an external fluid.

4. The HVAC system of claim 1, further comprising a second expansion device in fluid communication with the expansion device.

5. The HVAC system of claim 4, wherein the second expansion device comprises at least one of an electronically controlled motor driven electronic expansion valve (EEV), a thermostatic expansion valve, an isenthalpic expansion valve, a capillary tube assembly, and an orifice.

6. The HVAC system of claim 4, wherein the second expansion device comprises a substantially isentropic expansion device.

7. A heating, ventilation, and air conditioning (HVAC) system comprising:

a refrigerant expansion device, wherein the refrigerant expansion device comprises an inlet section, a flow section, and an expansion section comprising a gradually increasing diameter between the flow section and a most downstream end of the refrigerant expansion device, wherein the flow section comprises a diameter equal to a diameter of a most upstream diameter of the expansion section, and wherein a length of the expansion section is at least times 3 times the diameter of the flow section.

8. The HVAC system of claim 7, wherein the refrigerant expansion device comprises a substantially isentropic expansion device.

9. The HVAC system of claim 7, wherein the diameter of the expansion section increases over its length in a direction of flow of refrigerant through the refrigerant expansion device.

10. The HVAC system of claim 7, wherein a shoulder is not present between the flow section and the expansion section.

11. A method of operating a heating, ventilation, and air conditioning (HVAC) system, comprising:

receiving a refrigerant at a first pressure at an expansion device;

passing the refrigerant through the expansion device in an isentropic or substantially isentropic expansion; and passing the refrigerant to a downstream heat exchanger at a second pressure, wherein the second pressure is less than the first pressure, wherein passing the refrigerant through the expansion device comprises;

passing the refrigerant through an inlet section;

passing the refrigerant through a flow section, wherein the flow section comprises a diameter equal to a diameter of a most upstream diameter of the expansion section; and passing the refrigerant through an expansion section, wherein the expansion section is located downstream from the flow section, wherein the expansion section comprises a gradually increasing diameter between the flow section and a most downstream end of the expansion device, and wherein a length of the expansion section is at least 3 times the diameter of the flow section.

12. The method of claim 11, wherein the refrigerant is received at the expansion device as a liquid.

13. The method of claim 11, wherein passing the refrigerant through the flow section comprises:

passing the refrigerant through the flow section in a choked flow condition.

14. The method of claim 11, wherein passing the refrigerant through the expansion device further comprises: flashing a portion of the refrigerant from a liquid state to a vapor state within the flow section.

15. The method of claim 11, further comprising: absorbing heat in the downstream heat exchanger; and evaporating at least a portion of the refrigerant in the downstream heat exchanger in response to absorbing the heat.

16. The method of claim 11, wherein a thermodynamic quality of the refrigerant passing to the downstream heat exchanger is between about 0.01 and about 0.25.

* * * * *